US005375833A

United States Patent [19]

Marier, Jr.

[11] Patent Number: 5,375,833

[45] Date of Patent: Dec. 27, 1994

[54] GOLF PRACTICE DEVICE

[75] Inventor: Robert E. Marier, Jr., Palm City, Fla.

[73] Assignee: SwingMaker USA, Inc., Palm City, Fla.

[21] Appl. No.: 55,534

[22] Filed: Apr. 30, 1993

[51] Int. Cl.[5] ..... A63B 69/36

[52] U.S. Cl. ..... 273/186.1

[58] Field of Search ..... 273/191 R, 191 A, 191 B, 273/192, 186.1

[56] References Cited

U.S. PATENT DOCUMENTS 3,375,010 3/1968 Panza ..... 273/191 R X 3,942,802 3/1976 Wright ..... 273/192 X

FOREIGN PATENT DOCUMENTS 2192797 1/1988 United Kingdom ..... 273/191 R

*Primary Examiner*—George J. Marlo

*Attorney, Agent, or Firm*—Quarles & Brady

[57] ABSTRACT

A golf practice device includes a path guide elevated above the ground by a support that includes an extension defining a base target line. The path guide establishes an upper limit under which an arc of a correct golf swing should travel without contacting the guide while passing through the point of impact with ball to be driven. The device can be constructed with readily separable parts such as rod members and a tee joint pivotally and slidingly mounted in cantilever manner from a vertical support post, which can dissaemble and pivot relative to each other to accept high impact with the golf club and readily reassemble. The disassembly also permits convenient storage and transport. The pivoting members also permit orientations of the guide to correct hook and slice generating swings.

3 Claims, 2 Drawing Sheets

GOLF PRACTICE DEVICE

FIELD OF THE INVENTION

The present invention relates to recreational training equipment and more particularly to practice equipment to improve golf swings.

BACKGROUND OF THE INVENTION

A good golf swing is a product of the control of a multitude of factors. Of these factors, perhaps the most critical is the swing path of the club head slightly before contact with the golf ball until just after the contact, in a path range known as the "hitting zone."

In a correct swing, the club head generally traces a tilted circle through the air, moving inward toward the golfer and upward on the backswing and, on the return downswing, passing through the point of impact with the ball at approximately the location where the tilted circle meets the ground, before moving upward and inward into the finish of the swing.

Devices have been developed to train the golfer to follow the ideal tilted circle in his swing until muscle memory is developed to "groove" the swing. One device includes an actual tilted circular structure against which the club shaft slides during the complete swing motion. However, such devices do not necessarily permit the golfer to develop the correct body motions to perform a correct swing without the presence of the support surface.

SUMMARY OF THE INVENTION

The present invention is directed to a practice device to assist a golfer in improving his swing. The device is constructed to help the golfer develop and groove a consistent, correct swing path, particularly during the critical path range beginning slightly before contact with the ball and just after the contact, otherwise termed the "hitting zone." On the generally circular path of the swing, this critical zone begins at approximately the "eight o'clock" position and continues through to the "four o'clock" position. If the club head swing path follows the tilted circle, the club head will arc under an elevated line pointing toward the desired target through the hitting zone.

The present invention includes an elevated path guidance means to provide a reference of the line under which the swing should correctly arc. Incorrect deviation from this arc results in contact with the path guidance means and encourages the instinctive moves necessary to avoid contact with the path guidance means. The device trains the golfer without prescribing a specific swing method, thereby enabling the golfer to develop a correct swing through visual and muscular observations and adjustments.

The elevated path guidance means is suspended by a support and can be constructed to accept forceful contact with the swinging club. Preferably, the components of the path guidance means and the support are pivotally connected to rotate in reaction to impact and can be constructed of separable pieces which can readily break away under impact and easily be reassembled. This separability also facilitates compact storage and transport, The pivotal connections of the path guidance means and the support also enable the path guidance means to be rotated to different positions relative to means for defining a base target line aligned with the target. The adjustment of the path guidance means can be used to train the golfer to correct an ingrained swing error that causes slices or hooks.

BRIEF DESCRIPTION OF THE DRAWINGS

A more detailed understanding of the invention can be gained by a reading of the following description of the preferred embodiments in relation to the accompanying drawings, in which.

DESCRIPTION OF THE PREFERRED EMBODIMENTS

Figure 1:
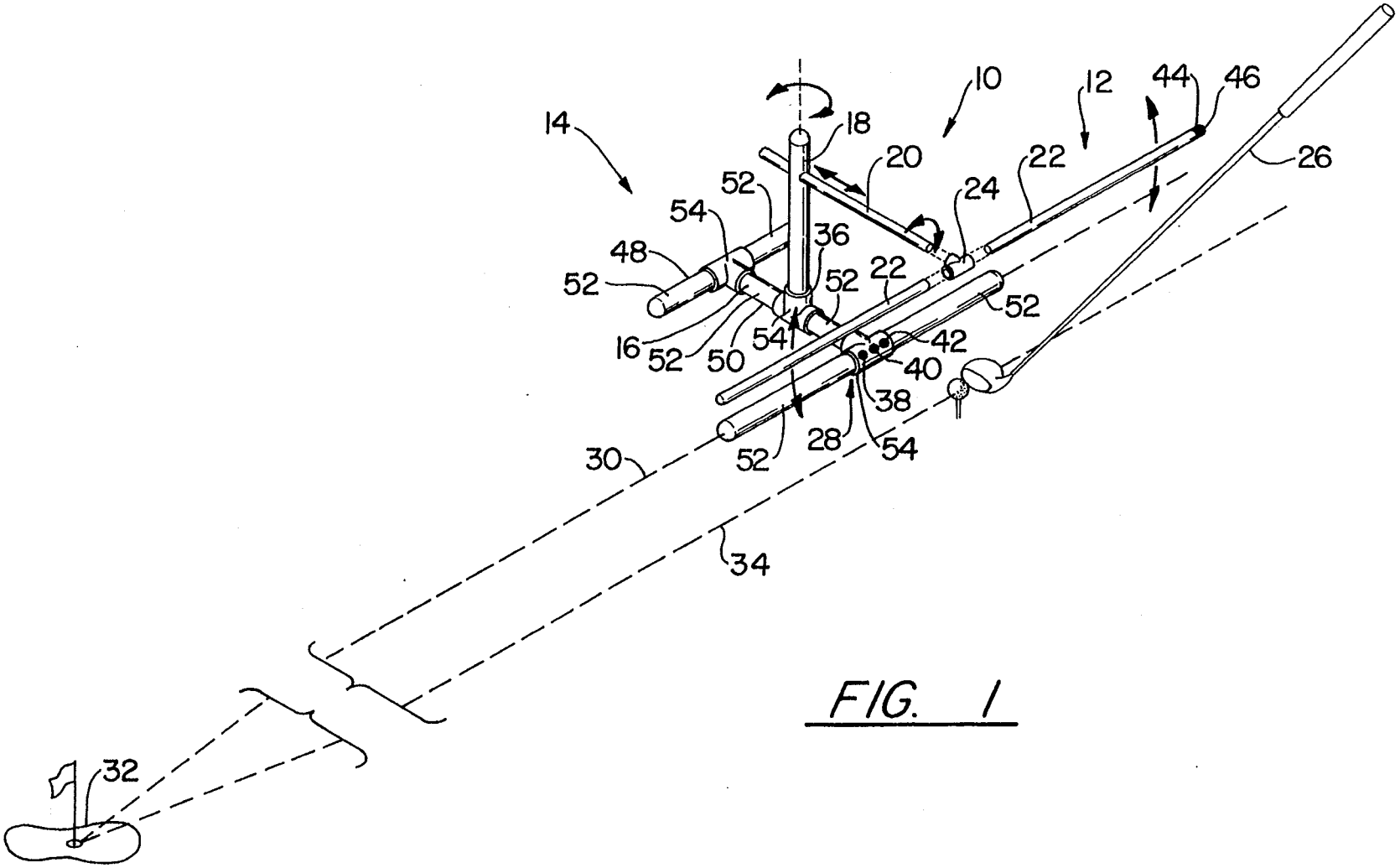
FIG. 1 is a perspective view of a preferred embodiment of a golf practice device according to the invention.

The present invention is concerned with a golf practice device that assists a golfer in developing a correct swing and correcting incorrect swing habits previously developed. Referring to FIG. 1, the device 10 generally includes an elevated path guidance means, such as a horizontal, elevated rod assembly 12. The rod assembly 12 can be elevated above the ground by a support 14, which preferably includes a base 16, a vertical column 18 and a support arm 20, extending cantilever from the vertical column 18 to secure the rod assembly 12. The support arm 20 can be slidingly connected to the vertical column 18 for horizontal sliding. Alternatively, the rod assembly 12 can be elevated above the ground by other structure that does not obstruct the club travel area below the rod assembly 12.

The path guidance means physically represents an elevated line under which a correct swing of the club head should arc, and can be formed by any generally linear structure elevated above the ground in a manner that there is no obstruction to travel of a club underneath the linear structure along its length. In the preferred rod assembly 12, a pair of rods 22 connect to opposite sides of a T-joint 24, which is further connected to the support arm 20. The rods 22 preferably extend approximately 3 feet from each side of the T-joint 24. The T-joint 24 is preferably pivotally mounted on the support arm 20 so that the rod assembly 12 can rotate in a vertical plane 8. In response to impact with a club 26, the rod assembly 12 can thus pivotally deflect to reduce the effects of the impact. The rods 22 and the T-joint 24 are also preferably fitted to easily separate under impact conditions to minimize the possibility of breakage of the individual components. The parts can readily be reassembled for continued use. The rod assembly 12 can alternatively be formed by a continuous shaft and fastened to the support structure by various fasteners, clamps or the like.

The practicing device 10 can also include means for defining a base target line, such as a front extension 28 of the base 16. Other structure, such as cord or an elongated rod, laid adjacent the base or connected to the base can also serve as means for defining a base target line. The front extension 28, which is preferred as a means for defining the base target line, is aligned with an imaginary line 30 extending to the desired target 32. In ordinary positioning of the path guidance means, the linear structure is aligned substantially parallel to the base target line. Thus, the rod assembly 12 can be positioned to align with a second target line 34 essentially parallel to the base target line and converging with the imaginary line 30 at the target 32 a substantial distance away.

Figure 2:
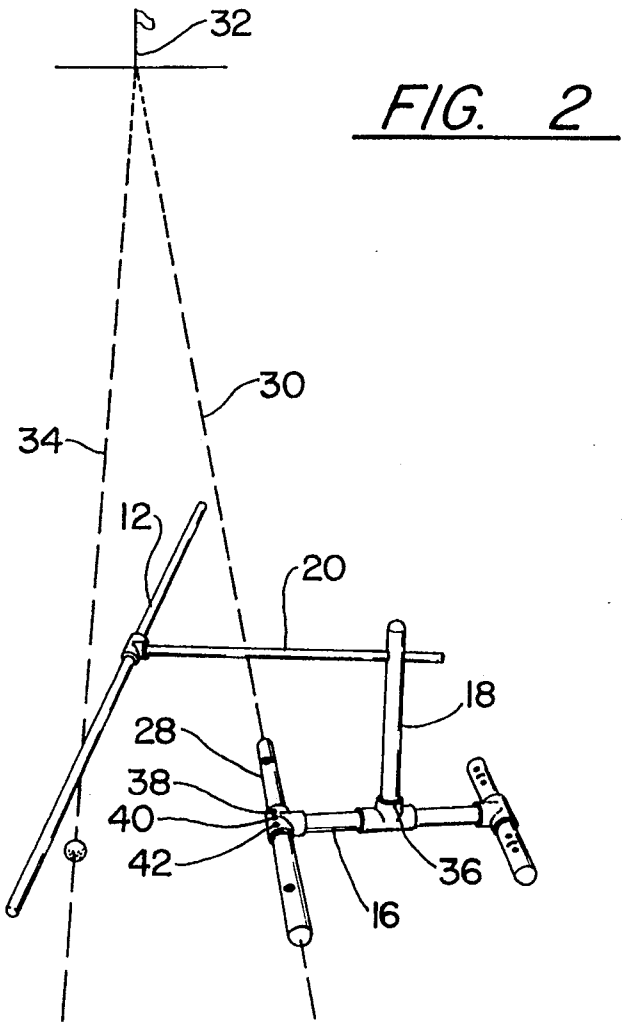
FIG. 2 is a perspective view of the golf practice device, showing an angling of a preferred elevated path guide to correct a slice producing swing.

The path guidance means can be adjusted to assist the golfer in correcting a swing habit that results in frequent slicing. Referring to FIG. 2, the rod assembly 12 can be rotated in the horizontal plane to angle relative to the base target line extending to the target 32 and defined by the base extension 28. This adjustment can be accomplished by rotating the column 18 relative to the base 28 so that the support arm 20 points toward a marker 38 on the base 16, slightly to the left of a center marker 40. In use, the slicing golfer aligns himself parallel to the base target line, as established by the extension 28 and swings the club 26 on a plane having an orientation generally parallel to the angled rod assembly 12 while maintaining body alignment with the base target line.

Figure 3:
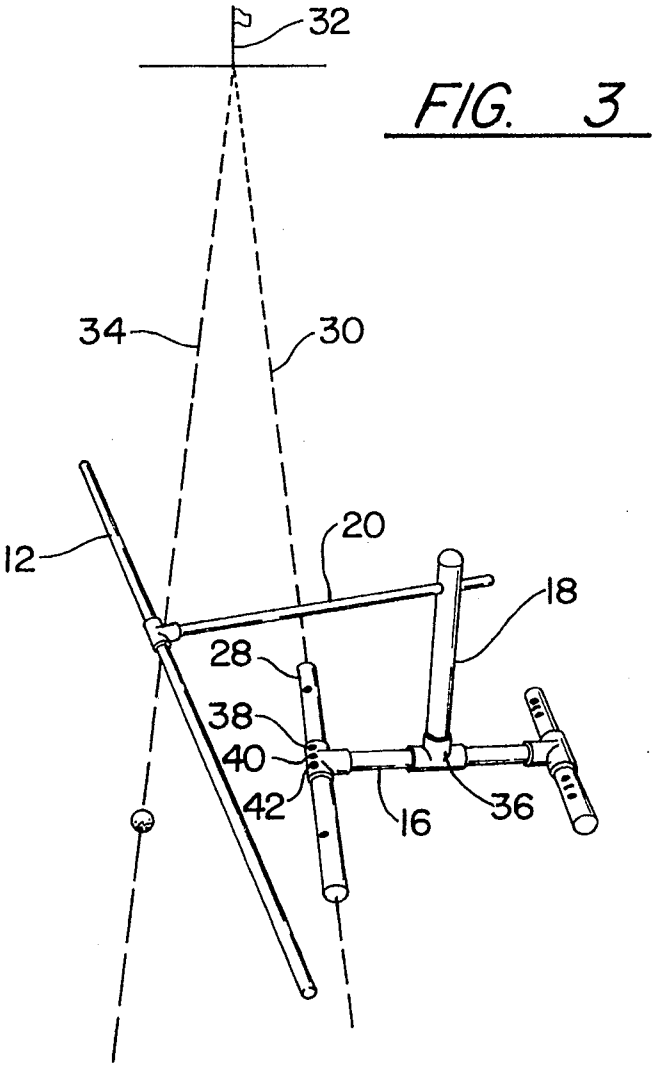
FIG. 3 is a perspective of the golf practice device, illustrating an angling of a preferred elevated path guide to correct a hook producing swing.

The path guidance means can also be adjusted to aid in correction of blocked shot and hook swings. Referring to FIG. 3, the rod assembly 12 can be rotated with the vertical column 18 so that the support arm 20 points to a rearward marker 42. While aligning with the base target line, the golfer preferably swings the club, on the downswing, on a plane having an orientation parallel to the angled rod assembly 12.

Referring again to FIG. 1, the practice device 10 can identify and signal swing errors by the impact of the club 26 with the path guidance means. For example, if the club 26 is raised during the backswing with independent motion of the hands and arms rather than primarily by torso rotation, the club 26 will strike the underside of the rear of the rod assembly 12. If the club 26 is cast early in the downswing by improper rotation of the shoulder, the club 26 will strike the top of the rod assembly 12. If the wrist cock is not released or if the forward body motion is excessive through ball contact and after, the club 26 will strike the underside of the forward portion of the rod assembly 12.

Many golfers fan the club face open excessively or pull the club around their bodies during the backswing, resulting in an incorrect club face angle or a deviation from the correct swing plane. To guide the golfer in maintaining a controlled backswing, the rod assembly 12 can provide a visual marking 44, such as a contrasting coloring, at the rear tip 46 of the rod to represent the correct "eight o'clock" position with which the club 26 should be aligned when the wrists begin to cock during the backswing under the momentum of the weight of the club head. During the backswing, the club 26 should be moved rearwardly by rotation of the torso and no independent motion of the arms and wrists until the club points to the eight o'clock marking 44.

During use, the golfer can initially place the ball six to twelve inches in front of the path guidance means, whereby the device serves as an alignment and reference guide without fear of contact with the device. Next, the ball can be placed directly below the center of the path guidance means to use the contact avoidance techniques encouraged by the device. If continued contact with the path guidance means occurs, adjustment of the orientation of the path guidance means can be made to correct the swing error.

After a consistent, correct swing begins to develop, the ball can be placed beyond the path guidance means toward the base target line. Preferably, the position of the ball between the path guidance means and the base target line is such that the golfer, when taking a normal stance can just see the toe of the club underneath the path guidance means.

Thus, the invention provides a golf practice device in which the pivoting connection of the path guidance means to the associated support means accomplishes a dual function of allowing angling of the path guidance means for correction of swing errors and readily moving under impact with a club to reduce the effects of the impact. The preferred separability of the components further reduces the potentially harmful effects of the club impact, and can facilitate compact storage and transport. In this regard, the preferred base can be constructed of separable components including the front extension 28, a rear extension 48 and a joining center bar 50, all formed by the insertion of tubing 52 into sockets of T-joints 54.

While preferred structure and techniques for using the invention have been discussed in detail, the specific features and preferences are not intended as limiting the scope of the invention. Rather, the scope of the invention should be determined by a reading of the appended claims.

I claim:

1. A golf practice device for assisting in the development of a correct golf swing, comprising:

an elevated path guidance means for establishing a linear path limit under which the correct golf swing can arc while passing through a stationary ball location; and support means for elevating said elevated path guidance means above the ground, wherein the path guidance means is a rod assembly elevated substantially horizontally and freely pivotally and slidingly connected to said support means to move under impact with a swinging golf club, said rod assembly including a tee joint and a pair of rods removably extending from opposite sides of said tee joint, said support means including a base, a vertical column mounted to said base, and a support arm extending from said vertical column and removably connecting to said tee joint, whereby said rods can disassemble from said tee joint and said tee joint can disassemble from said support arm under impact with the swinging golf club to minimize impact damage.

2. The device according to claim 1, wherein said vertical column is pivotally connected to said base, whereby said rod assembly can pivot in a horizontal plane.

3. The device according to claim 1, wherein said rods include visual marks at their ends to visually assist a user in determining correct club positioning at the take away stage of the swing.

* * * * *